United States Patent [19]

Heimes

[11] 3,981,134

[45] Sept. 21, 1976

[54] YARN GUIDE EYELET AND MONITORING MECHANISM IN A TEXTILE YARN PROCESSING MACHINE

[75] Inventor: Willy Heimes, Krefeld, Germany

[73] Assignee: Palitex Project-Company G.m.b.H., Krefeld, Germany

[22] Filed: July 3, 1975

[21] Appl. No.: 592,736

[30] Foreign Application Priority Data

July 11, 1974 Germany ..... 2433226

[52] U.S. Cl. ..... 57/81; 57/58.83; 57/106; 200/61.18

[51] Int. Cl.[2] ..... D01H 13/16

[58] Field of Search ..... 57/80, 81, 106, 34 R, 57/58.83; 200/61.13, 61.18

[56] References Cited

UNITED STATES PATENTS

| | | | |
|---|---|---|---|
| 2,579,407 | 12/1951 | Turner | 57/81 |
| 2,734,334 | 2/1956 | Saunders et al. | 57/81 |
| 3,132,466 | 5/1964 | Preisser | 57/81 |
| 3,354,627 | 11/1967 | Cizek et al. | 57/81 |
| 3,438,188 | 4/1969 | Boggs | 57/81 |
| 3,577,722 | 5/1971 | Adamaszek | 57/80 |
| 3,701,247 | 10/1972 | Rehn et al. | 57/81 |

*Primary Examiner*—John Petrakes
*Attorney, Agent, or Firm*—Bell, Seltzer, Park & Gibson

[57] ABSTRACT

In a textile yarn processing machine, such as a two-for-one twister and the like, having spindle assembly stations for the processing of yarn and each including devices forming a rotating balloon of running yarn and spindle control mechanisms, such as start and stop devices; the combination therewith is provided of a yarn guide eyelet and monitoring mechanism for operating the spindle control mechanisms in response to the absence and presence of yarn running therethrough, as follows. A yarn guide eyelet limits the upper end of the rotating balloon of yarn during passage of the running yarn therethrough which causes forces on the eyelet in the running direction of the yarn. A leaf spring movably supports the eyelet and biases the eyelet into a predetermined position in the absence of yarn running through the eyelet and allows angular movement of the eyelet in the running direction of the yarn out of the predetermined position by bending of the spring under the influence of the forces acting on the eyelet in the presence of yarn running through the eyelet. A device is responsive to the positioning of the eyelet into and out of the predetermined position thereof for operating the spindle control mechanisms.

13 Claims, 8 Drawing Figures

YARN GUIDE EYELET AND MONITORING MECHANISM IN A TEXTILE YARN PROCESSING MACHINE

This invention relates to a yarn guide eyelet and monitoring mechanism for operating spindle control mechanisms of a textile yarn processing machine in response to the absence and presence of yarn running through the yarn guide eyelet.

BACKGROUND OF THE INVENTION

In a textile yarn processing machine, particularly two-for-one twisters, it is desirable and has been the practice in some machines to monitor or sense the presence of yarns, threads, slivers, rovings, etc. (all collectively referred to hereinafter as "yarns") at certain monitoring locations for the purpose of effecting control functions, which may include the stopping or starting of the yarn processing machine or the particular work station of the machine, in the event of the absence or presence of yarn running through the particular monitoring location. While devices for such monitoring or sensing have previously been proposed, all such yarn monitoring devices exhibit various shortcomings to some degree.

In such textile yarn processing machines in which the running yarn forms a rotating balloon of yarn during such processing, a yarn guide eyelet is commonly positioned for limiting the upper end of the rotating balloon of yarn during passage of the running yarn through such eyelet. These yarn guide eyelets may be designed as a closed ring or a helical eye. As a consequence of centrifugal forces acting on the yarn by the rotating balloon of such yarn, tensions are created in the yarn in the zone of the rotating balloon of such yarn. Also, tensions are formed in the running yarn as a result of drawing off of the yarn from the supply package during the yarn processing operation. Both of the above produced tensions are added together or combined at the point in which the running yarn passes through the yarn guide eyelet and, therefore, produce combined forces on the eyelet in the running direction of the yarn which may be utilized for yarn monitoring or sensing purposes.

In a two-for-one twister textile yarn processing machine, as described in German Pat. No. 1,181,594, a helical type yarn guiding eyelet is maintained in generally horizontal position by these forces produced by the rotating yarn balloon when the yarn is running. In the event of yarn breakage or the absence of running yarn, the helical yarn guide eyelet swivels downwardly around a horizontal axis thereby triggering off various switching processes for spindle control mechanisms, including stop devices. The helical yarn guide eyelet is again supported by the rotating balloon of yarn after the yarn has been threaded in and the spindle assembly station reactivated. Thus, the helical yarn guide eyelet of this machine acts at the same time as a yarn sensor or monitor.

Yarn guide eyelets which can be swivelled or pivoted around fixed axes and which act at the same time as yarn sensors or monitors exhibit the drawback of the swivels or pivots being subjected to wear, mainly due to a high degree of pick-up of dirt, lint or other foreign matter and, thus, require continuous maintenance. The operation of this kind of pivoted or swivelly mounted yarn guide eyelets for acting as sensors or monitors for running yarn is not very reliable.

Yarn sensors or monitors normally act on electrical switches, more specifically micro-switches, which, inter-alia, operate spindle control mechanisms, including start and stop devices. These switches were heretofore positioned in the lever path of a holder or lever arm of a thread guide eyelet which was pivotally or swivelly mounted for engagement and disengagement thereby. However, micro-switches require normal switching forces of about 100 grams. Because of the arranging or positioning of such a switch within the swiveling or pivoting path of a thread guide eyelet lever arm, there was required long lever arms to produce the switching force normally required for the operation of such micro-switches. Therefore, these arrangements provided design deficiencies with respect to the lever arms for the pivotally or swivelly mounted yarn guide eyelet to also function as a yarn monitor or sensor.

OBJECTS AND SUMMARY OF THE INVENTION

Accordingly, it is the object of this invention to provide an improved yarn guide eyelet and monitoring mechanism at a spindle assembly station of a textile yarn processing machine for operating spindle control mechanisms of such machine in response to the absence and presence of yarn running through the yarn guide eyelet and monitoring mechanism and which overcomes the above and other problems and inadequacies of previously proposed mechanisms.

It is a further more specific object of this invention to provide such an improved yarn guide eyelet and monitoring mechanism which is not subjected to problems occurring from pick-up of dirt, lint or other foreign material in the spindle assembly station of a textile yarn processing machine and which provides sensitive switching operation for electrical switches, such as micro-switches, or other means responsive to the positioning of the eyelet as a result of the presence or absence of running yarn moving through the eyelet.

It has been found by this invention that the above objects may be accomplished by providing, in a textile yarn processing machine, such as a two-for-one twister and the like, having spindle assembly stations for the processing of yarn and each including means forming a rotating balloon of running yarn during such processing and spindle control mechanisms, such as start and stop devices; the combination therewith of a yarn guide eyelet and monitoring mechanism at each of the spindle assembly stations for operating the spindle control mechanisms in response to the absence and presence of a yarn running through the yarn guide eyelet and monitoring mechanism, as follows.

A yarn guide eyelet is positioned in the spindle assembly station for limiting the upper end of the rotating balloon of yarn during passage of the running yarn therethrough which causes forces on the eyelet in the running direction of the yarn. A generally flat, leaf spring is mounted on one side to the machine and movably supports the eyelet and biases the eyelet into a predetermined position in the absence of yarn running through the eyelet and allows angular movement of the eyelet in the running direction of the yarn out of the predetermined position by bending of the spring under the influence of the forces acting on the eyelet in the presence of yarn running through the eyelet. Means are operatively connected with the spindle control mechanisms and are responsive to the positioning of the eyelet into and out of the predetermined position thereof for operating the spindle control mechanisms.

Preferably, the leaf spring includes incisions extending inwardly from the one side rigidly mounted to the machine for forming a predetermined bending zone in the leaf spring at the zone of the inward ends of the incisions. The means operatively connected with the spindle control mechanisms and responsive to the positioning of the eyelet and the leaf spring into and out of the predetermined position thereof for operating the spindle control mechanisms preferably comprises an electrical switch positioned adjacent the leaf spring for being engaged and disengaged when the eyelet is in the predetermined position occurring in the absence of yarn running through the eyelet and when the eyelet is moved out of the predetermined position under the influence of the forces acting on the eyelet in the presence of yarn running through the eyelet for accomplishing switching functions for operating the spindle control mechanisms.

Further specific features of the preferred embodiment of the mechanism of this invention will be seen from the following more detailed description.

BRIEF DESCRIPTION OF THE DRAWINGS

Some of the objects and advantages of this invention having been set forth, other objects and advantages will appear when taken in conjunction with the accompanying drawings, in which.

DESCRIPTION OF PREFERRED EMBODIMENT

While the drawings and specific description to follow will be related to a two-for-one twister textile yarn processing machine, which is the preferred form of machine utilizing the improved yarn guide eyelet and monitoring mechanism of this invention, it is to be understood that this improved mechanism could be utilized with other types of textile yarn processing machines which form a rotating balloon of the yarn during such processing and for which monitoring of the yarn and operation of control mechanisms is desired.

Figure 1:
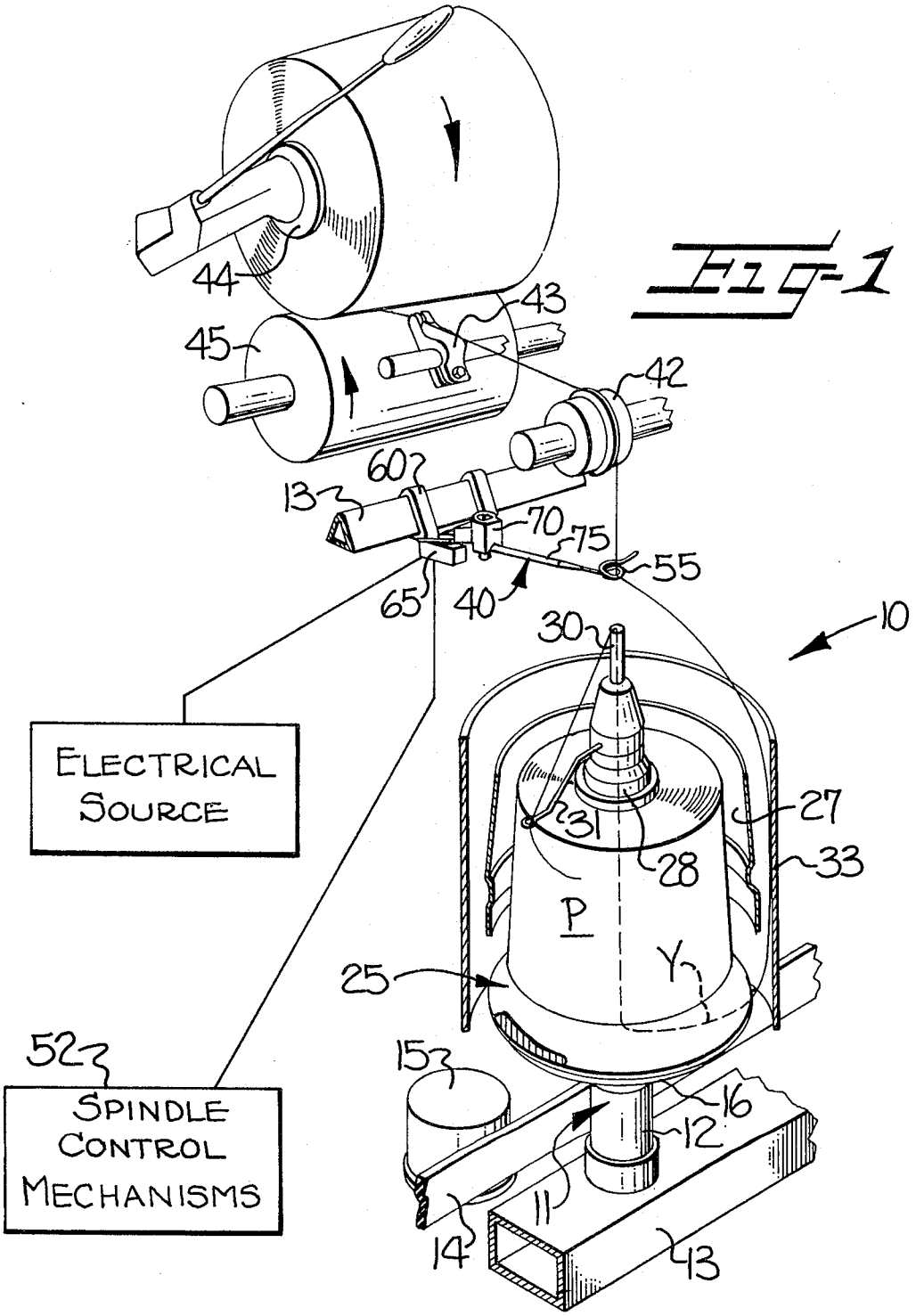
FIG. 1 is a schematic perspective view, partially broken away, illustrating one spindle assembly station of a two-for-one twister textile yarn processing machine utilizing the improved yarn guide eyelet and monitoring mechanism of this invention.
Figure 2:
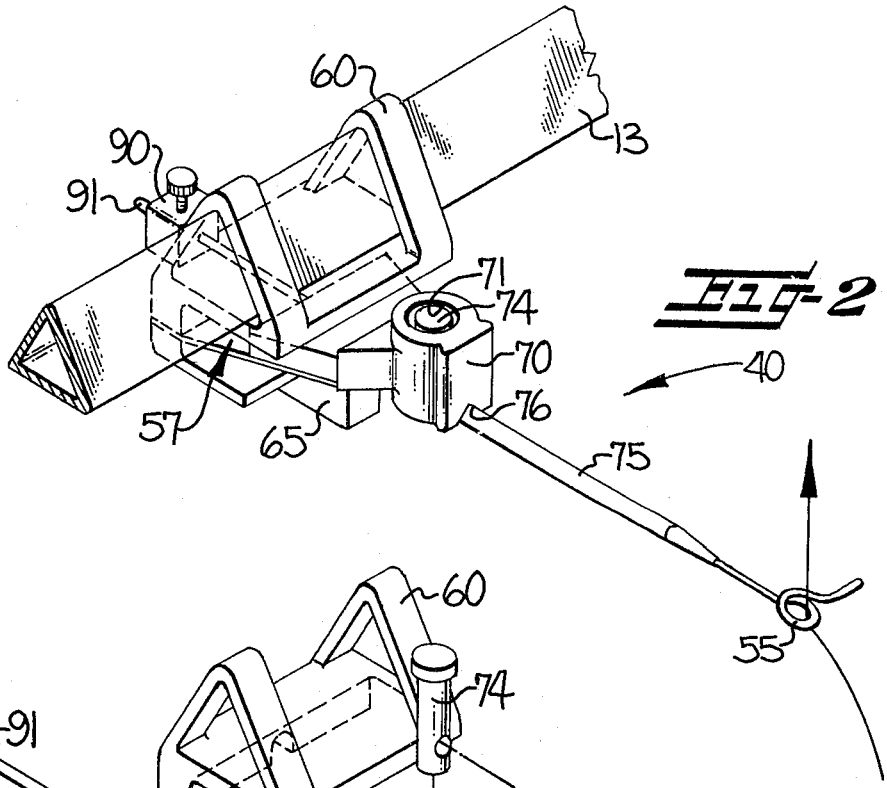
FIG. 2 is an enlarged perspective view of the yarn guide eyelet and monitoring mechanism illustrated in FIG. 1.

Referring now to the drawings, there is illustrated in FIg. 1 a schematic view of one spindle assembly station of a two-for-one twister textile yarn processing machine. It is to be understood that a plurality of these spindle assembly stations are provided in generally side-by-side relationship in two rows along the outsides of the yarn processing machine. A full illustration and description of the entire two-for-one twister textile yarn processing machine is not given herein and is not believed to be necessary for an understanding of the present invention, the operation and structure of such a two-for-one twister textile yarn processing machine being well understood by those with ordinary skill in the art.

Generally, each of the spindle assembly stations comprise a spindle assembly, generally indicated at 10. The spindle assembly 10 includes a rotatably driven rotor mechanism 11 which includes a whorl 12 suitably rotatably mounted on a portion of the twister frame 13 and rotated by a continuous drive belt 14 which is held in selective engagement therewith by a roll 15 in a manner well understood by those with ordinary skill in the art. The rotor mechanism 11 further includes a generally horizontally extending reserve disc 16 which defines a generally horizontally extending yarn passageway (indicated by the dotted line path of yarn Y in FIG. 1).

The spindle assembly 10 further includes a carrier mechanism 25 for carrying a hollow package P of the yarn Y and being rotatably mounted on the rotor mechanism 11 by bearings (not shown) so that the rotor mechanism 11 may rotate relative to the carrier mechanism 25 which is maintained generally stationary. The carrier mechanism 25 includes a basket device 27 which surrounds the package P of yarn Y and a hollow yarn package carrier member 28 onto which the hollow package P of yarn Y is supported. The hollow carrier member 28 may also include a hollow yarn entry tube 30 carried with the carrier member 28 and extending outwardly therefrom axially of the supply package P for receiving the yarn Y from the supply package P after it passes through a flier mechanism 31 and for providing an axially extending passageway through the hollow interior thereof (indicated by the dotted line path of the yarn Y in FIG. 1) which mates with the hollow interior of the carrier member 28 which also provides a passageway for the yarn Y (indicated by the dotted line path of the yarn Y in FIG. 1) and which mates with the passageway of the rotor mechanism 11.

The spindle assembly 10 further includes a balloon limitor device 33 surrounding the basket device 27 so as to contain a balloon of yarn Y formed on the outside of the basket device 27. A yarn guide eyelet and monitoring mechanism 40, in accordance with this invention and to be descirbed more fully below, is mounted on another portion of the machine frame 13 and is positioned above and in axial alignment with the yarn entry tube 30 for receiving and passing therethrough the running yarn Y as it is processed through the spindle assembly 10 and for limiting the upper end of the rotating balloon of yarn Y.

The spindle assembly station further includes take-up mechanisms for the spindle assembly 10 including a pre-take-up roll 42, a traversing mechanism 43, a package roll device 44 for forming a package of the processed yarn Y and which is rotated by a driven roll 45.

With the above-described conventional elements of a spindle assembly station of a two-for-one twister textile yarn processing machine, the yarn Y passes from the package P through the flier mechanism 31 and into and through the yarn entry tube 30, carrier member 28 and horizontally out of the reserve disc 16. The yarn Y then passes upwardly between the basket device 27 and the balloon limitor 33 and forms a rotating balloon of the yarn Y which is contained by the balloon limitor 33. The yarn then passes through the yarn guide eyelet mechanism 40 which limits the upper end of the rotating balloon of yarn Y and forms the point or vertex thereof. The yarn Y then passes over pre-take-up roll 42 and is traversed by traversing mechanism 43 onto the take-up package or take-up roll 44 which is surface driven by the roll 45. As is well understood by those with ordinary skill in the art, a two-for-one twist is inserted in the yarn Y during the above-noted path of travel due to rotation of the rotor mechanism 11 causing rotation of the balloon of yarn Y, as described above.

In accordance with the present invention, a specifically constructed yarn guide eyelet and monitoring mechanism 40 is provided at each spindle assembly station for operating spindle control mechanisms, broadly and schematically illustrated as such in FIG. 1 and indicated at 52, in response to the absence and presence of yarn Y running through the yarn guide eyelet and monitoring mechanism 40. The spindle control mechanisms 52 may include conventional start motion devices, stop motion devices, visual indicator signals which may include lamps, bells, etc., or other control mechanisms for stopping or indicating the need of stopping of the spindle assembly station or the entire two-for-one twister textile yarn processing machine and which may include conventional transmission and braking equipment. Suitable control mechanisms are disclosed in U.S. Pats. Nos. 3,805,507 and 3,565,356, both assigned to the assignee of the present invention, and are well understood by those with ordinary skill in the art of textile yarn processing machines and a complete description herein is not believed herein necessary for an understanding of the present invention.

The yarn guide eyelet and monitoring mechanism 40 includes a yarn guide eyelet 55, which as illustrated in the drawings is in the form of a helical eyelet, but which could also be in the form of a closed eye or other desired configuration, positioned in the spindle assembly station for limiting the upper end or forming the vertex of the rotating balloon of yarn Y during the passage of the running yarn therethrough. As discussed above, the running yarn causes forces on the eyelet 55 in the running direction of the yarn Y as indicated in FIG. 5.

Figure 5:
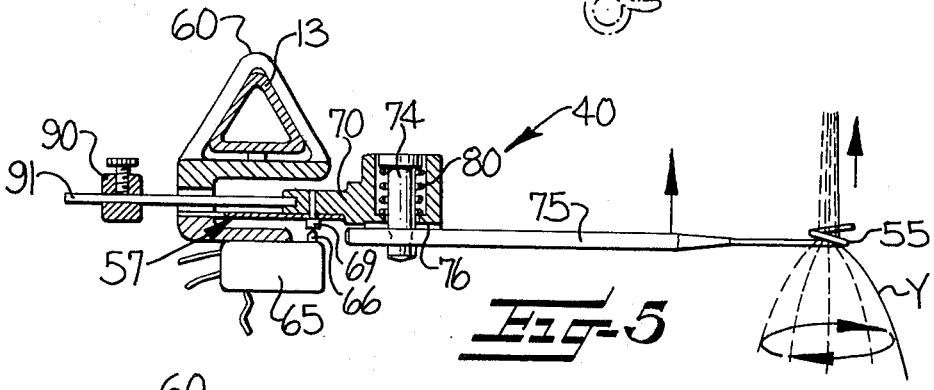
FIG. 5 is a sectional view, taken generally along the line 5—5 of FIG. 4, illustrating the yarn guide eyelet and monitoring mechanism in the condition thereof when yarn is running through the eyelet.
Figure 6:
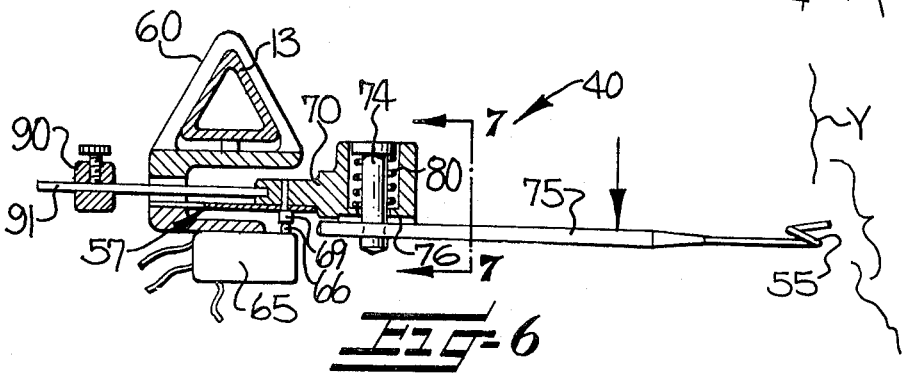
FIG. 6 is a view, like FIG. 5, illustrating the condition of the yarn guide eyelet and monitoring mechanism in the absence of yarn running through the eyelet thereof.
Figure 7:
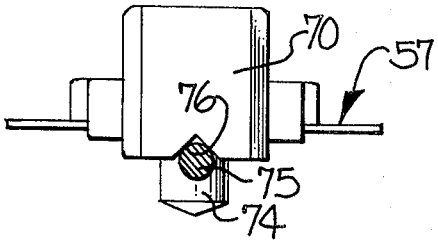
FIG. 7 is a sectional view, taken generally along the line 7—7 of FIG. 6.
Figure 8:
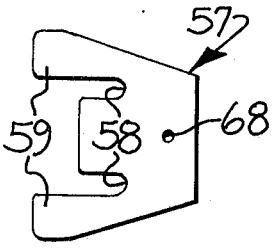
FIG. 8 is a top plan view of the leaf spring utilized in the yarn guide eyelet and monitoring mechanism of this invention.

The yarn guide eyelet and monitoring mechanism further includes a generally flat, leaf spring 57 mounted on one side to a portion of the machine frame 13 and movably supporting the eyelet 55 and biasing the eyelet into a predetermined position, as shown in FIG. 6, in the absence of yarn running through the eyelet 55 and allowing angular movement of the eyelet 55 in the running direction of the yarn Y out of the predetermined position, as shown in FIG. 5, by bending of the leaf spring 57 under the influence of the above-described forces acting on the eyelet 55 in the presence of yarn running through the eyelet.

Figure 3:
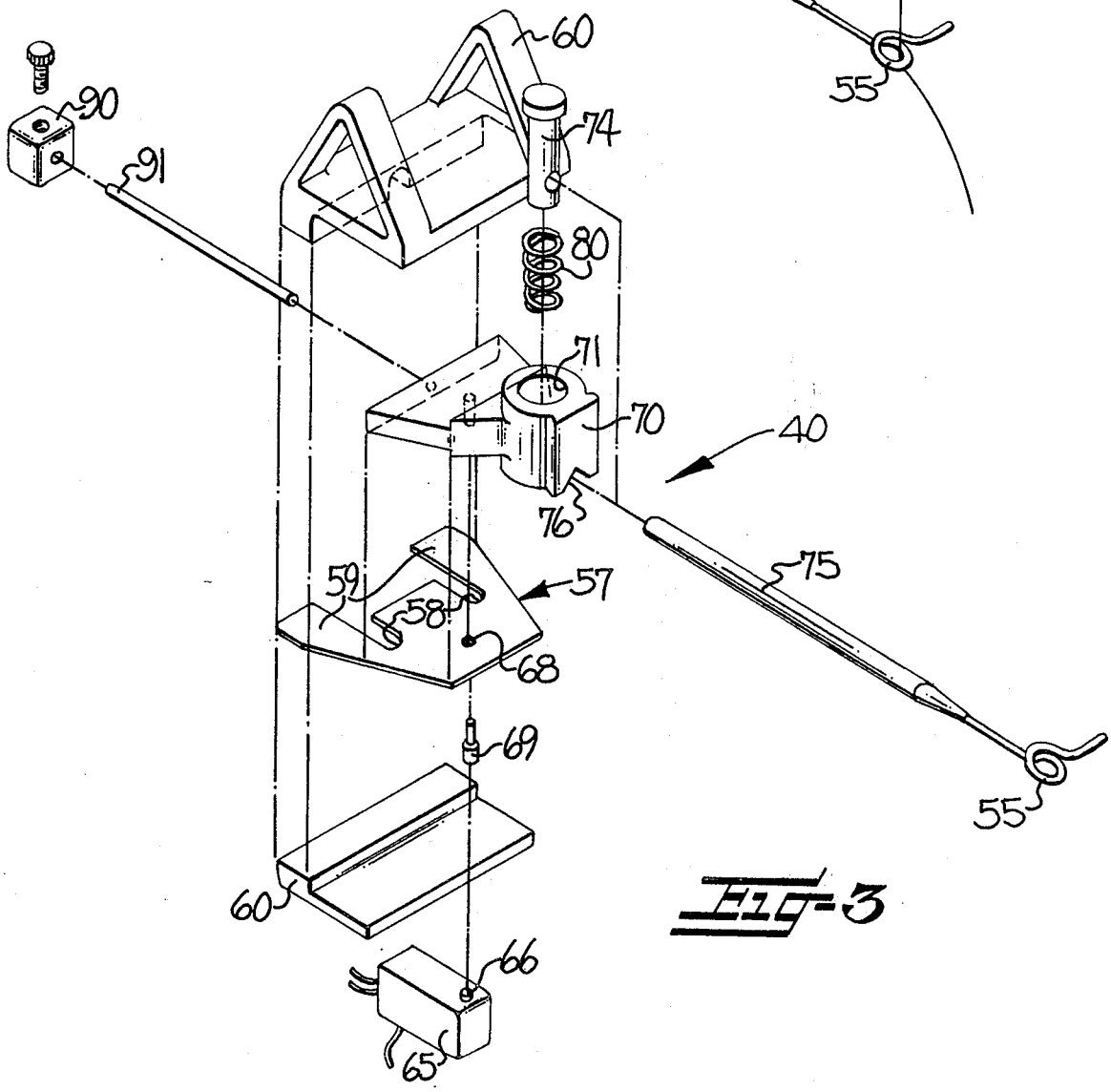
FIG. 3 is an exploded view of the components of the yarn guide eyelet and monitoring mechanism illustrated in FIG. 2.

As illustrated in the drawings, the leaf spring 57 is mounted on one side to a portion of the machine frame 13 by a suitably configured holding member 60 which maybe of a two-piece construction, as shown particularly in FIG. 3, in which the two pieces are held together in any suitable manner, such as by fasteners or the like (not shown). The holding member 60 is suitably positioned around and supported on the generally triangular machine frame portion 13 and receives and secures one end of the leaf spring 57.

The leaf spring 57 preferably includes incisions 58 extending inwardly from the one side rigidly mounted to the machine frame 13 or from the side held by the holding member 60 for forming a predetermined bending zone in the leaf spring 57 at the zone of the inward ends of the incisions 58 so that the leaf spring will bend in the preferred zone to accomplish precise switching functions, to be described below. As a result of the incisions 58 in the leaf spring 57, the leaf spring assumes a generally U-shape configuration having outer leg portions 59 which broaden toward the free ends of the legs and which are rigidly mounted in the holding member 60 for securing the same to the machine frame portion 13.

The above-described leaf spring 57 is designed so as to be horizontally rigid and to bias the eyelet 55 into a predetermined position while allowing movement of the eyelet 55 against the bias of the spring 57 by bending of the spring through the bending zone to permit movement of the eyelet 55 out of the predetermined position without the need for any swivel bearings or pivotal connections which are subjected to interference, wear and other problems The yarn guide eyelet and monitoring mechanism 40 further includes means 65 operatively connected with the spindle control mechanisms 42 and being responsive to the positioning of the eyelet 55 into and out of the predetermined position thereof for operating the spindle control mechanisms.

As illustrated in the drawings, this means 65 comprises an electrical switch, preferably a micro-switch, electrically connected to an electrical source and to the spindle control mechanisms 52, as indicated in FIG. 1, and having an upstanding switching member 66 which normally is biased in the upper position thereof and which may be engaged for depressing the switching member 66 and disengaged for releasing the switching member 66 to accomplish switching functions of the electrical switch 65. The switch 65 is mounted on and carried by the underside of the holding member 60 so that the switching member 66 is positioned under the leaf spring 57 at the forward end thereof and on the other side of the bending zone thereof. The leaf spring 57 may include an aperture 68 therein for receipt of a switching pin 69 which depends downwardly therefrom and is in alignment with the switching member 66. Thus, when the eyelet 55 is maintained out of the predetermined position, as illustrated in FIG. 5, by the forces on the eyelet 55 caused by the running yarn Y passing therethrough, the switching pin 69 will be out of engagement with the switching member 66 of the electrical switch 65. On the other hand, if the yarn Y is broken or otherwise not running through the eyelet 55, the leaf spring 57 will bias the eyelet 55 into the predetermined position, shown in FIG. 6, so that the switching pin 69 will depress the switching member 66 of the electrical switch 65. The above action will cause switching functions of the electrical switch 65 for operating the spindle control mechanisms 52.

Figure 4:
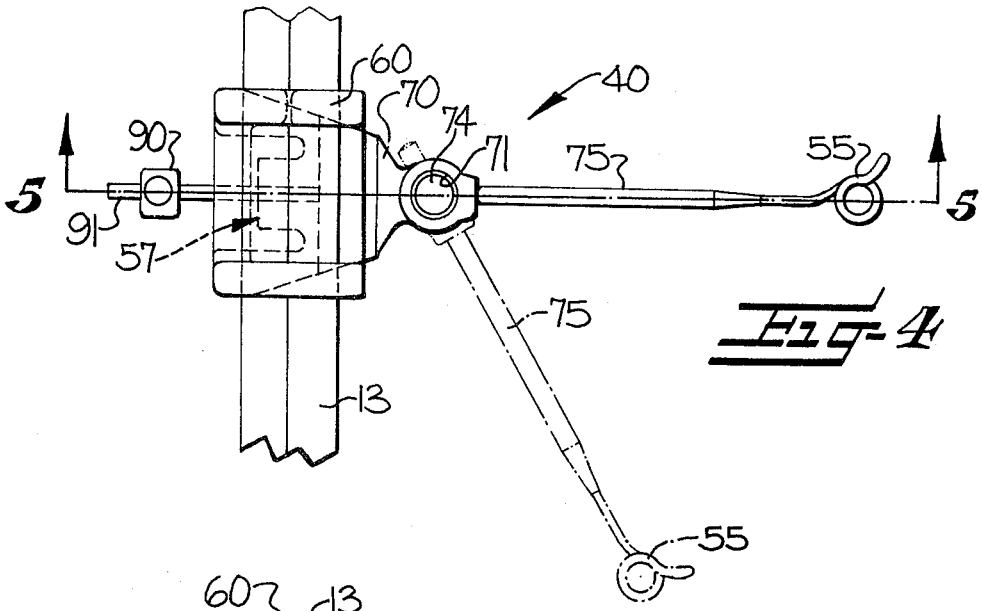
FIG. 4 is a top plan view of the yarn guide eyelet and monitoring mechanism of FIG. 2.

The yarn guide eyelet and monitoring mechanism 40 may further include means pivotally mounting the eyelet 55 on the leaf spring 57 for lateral movement of the eyelet 55 into and out of the path of the running yarn Y for movement out of the path during threading up or the like of the textile yarn processing machine. As illustrated in the drawings, this pivotal mounting means comprises a holder 70 carried by the forward end of the leaf spring 57 and having a forward portion defining an aperture 71 therethrough: A pivot pin 74 extends through the aperture 71 in the holder 70 for rotational movement therein and is secured to a carrier rod 75 extending rearwardly from the eyelet 55 and positioned generally perpendicular to the pivot pin 74 and the aperture 71 in the holder 70. The pivot pin may rotate in the holder 70 for pivoting rotational movement of the eyelet 55 into and out of the path of the running yarn Y, as indicated in solid and dotted lines in FIG. 4.

The holder 70 includes a notch 76 in the underside thereof for receiving the carrier rod 75 of the eyelet 55 to deter pivoting movement thereof. The pivot pin 74 is biased in an upward direction by a spring 80 to bias the carrier rod 75 into the notch 76. Pivoting movement of the eyelet 55 may be accomplished by depression of the pivot pin 74 against the bias of the spring 80 to push the carrier rod 75 out of the notch 76 and allow manual pivoting movement of the eyelet 55 out of the path of the running yarn Y for threading up of the yarn processing machine, if desired.

The yarn guide eyelet and monitoring mechanism may also include adjustable counterbalancing weight means in the form of a weight 90 adjustably carried on a rod 91 having the forward end thereof secured to the rear end of the holder 70 for adjustably fixing or counterbalancing the predetermined position assumed by the eyelet 55 in the absence of yarn Y running through the eyelet 55.

By the above construction, an improved yarn guide eyelet and monitoring mechanism 40 is provided which utilizes the forces created on the eyelet 55 by the running yarn Y to accomplish switching functions of an electrical switch 65 depending upon the presence or absence of yarn running through the eyelet 55 which is movably carried by a leaf spring 57 and eliminates the necessity of a pivot or swivel mounting for the eyelet 55, and permits the use and operation of intrinsically harshly responding micro-switches by means of a very slight differential force.

In the drawings and specification, there has been set forth a preferred embodiment of this invention, and although specific terms are employed, they are used in a generic and descriptive sense only and not for purposes of limitation.

What is claimed is:

1. In a textile yarn processing machine, such as a two-for-one twister and the like, having spindle assembly stations for the processing of yarn and each including means forming a rotating balloon of running yarn during such processing and spindle control mechanisms, such as start and stop devices; the combination therewith of a yarn guide eyelet and monitoring mechanism at each of said spindle assembly stations for operating said spindle control mechanisms in response to the absence and presence of yarn running through said yarn guide eyelet and monitoring mechanism, said yarn guide eyelet and monitoring mechanism comprising:

a yarn guide eyelet positioned in said spindle assembly station for limiting the upper end of the rotating balloon of yarn during passage of the running yarn therethrough which causes forces on said eyelet in the running direction of the yarn;

a generally flat, leaf spring mounted on one side to said machine and movably supporting and carrying said eyelet on the other side thereof and biasing said eyelet into a predetermined position in the absence of yarn running through said eyelet and allowing angular, non-swivelable movement of said eyelet in the running direction of the yarn out of the predetermined position by bending of said spring under the influence of the forces acting on said eyelet in the presence of yarn running through said eyelet; and means operatively connected with said spindle control mechanisms and being responsive to the positioning of said eyelet into and out of the predetermined position thereof for operating said spindle control mechanisms.

2. In a textile yarn processing machine, as set forth in claim 1, in which said leaf spring includes incisions extending inwardly from the one side rigidly mounted to said machine for forming a predetermined bending zone in said leaf spring at the zone of the inward ends of said incisions.

3. In a textile yarn processing machine, as set forth in claim 2, in which said leaf spring comprises a generally U-shaped, normally planar configuration having outer leg portions which broaden towards the free end of said legs, and the free end of said legs being rigidly mounted to said machine.

4. In a textile yarn processing machine, as set forth in claim 1, in which said means operatively connected with said spindle control mechanisms and being responsive to the positioning of said eyelet into and out of the predetermined position thereof for operating said spindle control mechanisms comprises an electrical switch.

5. In a textile yarn processing machine, as set forth in claim 4, in which said electrical switch includes an upstanding switching member positioned adjacent said leaf spring for being engaged and disengaged when said eyelet is in the predetermined position occurring in the absence of yarn running through said eyelet and when said eyelet is moved out of the predetermined position under the influence of the forces acting on said eyelet in the presence of yarn running through said eyelet for accomplishing switching functions to operate said spindle control mechanisms.

6. In a textile yarn processing machine, as set forth in claim 1, in which said yarn guide eyelet and monitoring mechanism further includes adjustable counterbalancing weight means for adjustably fixing the predetermined position assumed by said eyelet in the absence of yarn running through said eyelet.

7. In a textile yarn processing machine, as set forth in claim 1, in which said yarn guide eyelet and monitoring mechanism includes means pivotally mounting said eyelet on said leaf spring for lateral movement into and out of the path of the running yarn for movement out of the path during threading-up or the like of said textile yarn processing machine.

8. In a textile yarn processing machine, as set forth in claim 7, in which said yarn guide eyelet includes a carrier rod extending rearwardly from said eyelet and in which said means for pivotally mounting said eyelet comprises a holder carried by said leaf spring and having a forward portion defining an aperture therethrough in a direction generally perpendicular to the extension of said carrier rod of said eyelet and a pivot pin extending through said aperture in said holder for rotational movement therein and being secured to said carrier rod for pivoting rotational movement thereof.

9. In a textile yarn processing machine, as set forth in claim 8, in which said holder includes a notch on one side thereof for receiving said carrier rod of said eyelet therein to deter pivoting movement thereof and in which said pivot pin includes means biasing said pivot pin in the opposite direction from said notch in said holder for biasing said carrier rod into said notch and for allowing movement of said pivot pin in opposition to said biasing means for moving said carrier rod out of said notch in said holder to allow pivotal movement of said eyelet.

10. In a textile yarn processing machine, such as a two-for-one twister and the like, having spindle assembly stations for the processing of yarn and each including means forming a rotating balloon of running yarn during such processing and spindle control mechanisms, such as start and stop devices; the combination therewith of a yarn guide eyelet and monitoring mechanism at each of said spindle assembly stations for operating said spindle control mechanisms in response to the absence and presence of yarn running through said yarn guide eyelet and monitoring mechanism, said yarn guide eyelet and monitoring mechanism comprising:

a yarn guide eyelet positioned in said spindle assembly station for limiting the upper end of the rotating balloon of yarn during passage of the running yarn therethrough which causes forces on said eyelet in the running direction of the yarn;

a generally flat, leaf spring rigidly mounted on one side to said machine and having incisions extending inwardly from the one side for forming a predetermined bending zone in said leaf spring at the zone of the inward ends of said incisions, said leaf spring movably supporting and carrying said eyelet on the other side thereof and biasing said eyelet into a predetermined position in the absence of yarn running through said eyelet and allowing angular non-swivelable movement of said eyelet in the running direction of the yarn out of the predetermined position by bending of said spring in said bending zone under the influence of the forces acting on said eyelet and the presence of yarn running through said eyelet; and electrical switch means operatively connected with said spindle control mechanisms and being positioned adjacent said leaf spring for being engaged and disengaged when said eyelet is in the predetermined position occurring in the absence of yarn running through said eyelet and when said eyelet is moved out of the predetermined position under the influence of the forces acting on said eyelet in the presence of yarn running through said eyelet for accomplishing switching functions for operating said spindle control mechanism.

11. In a textile yarn processing machine, as set forth in claim 10, in which said yarn guide eyelet and monitoring mechanism includes a carrier rod extending rearwardly from said eyelet, a holder carried by said leaf spring and having a forward portion defining an aperture therethrough in a direction generally perpendicular to the extension of said carrier rod, a pivot pin extending through said aperture and said holder for rotational movement therein and being secured to said carrier rod for pivotal rotational movement thereof for laterally moving said eyelet into and out of the path of the running yarn for aiding threading-up or the like of the textile yarn processing machine.

12. In a textile yarn processing machine, as set forth in claim 11, in which said holder includes a notch on one side thereof for receiving said carrier rod of said eyelet therein to deter pivoting movement thereof and in which said pivot pin includes means biasing said pivot pin in the opposite direction from said notch in said holder for biasing said carrier rod to said notch and for allowing movement of said pivot pin in opposition to said biasing means for moving said carrier rod out of said notch in said holder to allow pivotal movement of said eyelet.

13. In a textile yarn processing machine, as set forth in claim 10, in which said yarn guide eyelet and monitoring mechanism further includes adjustable counterbalancing weight means for adjustably fixing the predetermined position assumed by said leaf spring and said eyelet in the absence of yarn running through said eyelet.

* * * * *